US006846941B2

(12) United States Patent
Rohr et al.

(10) Patent No.: US 6,846,941 B2
(45) Date of Patent: Jan. 25, 2005

(54) PROCESS FOR SEPARATING UNSAPONIFIABLE VALUABLE PRODUCTS FROM RAW MATERIALS

(75) Inventors: Rodolfo Rohr, Caminas (BR); Raul Rohr, Ladera Ranch, CA (US); Jose Anibal Trujillo-Quijano, Blumenau (BR)

(73) Assignee: Resitec Industria Quimica Ltda., Duque de Caxias RJ (BR)

( * ) Notice: Subject to any disclaimer, the term of this patent is extended or adjusted under 35 U.S.C. 154(b) by 16 days.

(21) Appl. No.: 10/079,062

(22) Filed: Feb. 20, 2002

(65) Prior Publication Data

US 2003/0120095 A1 Jun. 26, 2003

(30) Foreign Application Priority Data

Dec. 17, 2001 (BR) ..... P10106522

(51) Int. Cl.[7] ..... C11B 3/00

(52) U.S. Cl. ..... 554/195; 549/413; 552/296; 552/540; 562/498; 562/499; 585/809

(58) Field of Search ..... 554/195, 19; 552/296, 552/540; 562/498, 499; 585/809; 549/413

(56) References Cited

U.S. PATENT DOCUMENTS

| | | | | |
|---|---|---|---|---|
| 4,151,160 A | * | 4/1979 | Koebner | 554/202 |
| 4,483,791 A | | 11/1984 | Phillips, Jr. et al. | |
| 4,524,024 A | | 6/1985 | Hughes | |
| 5,097,012 A | | 3/1992 | Thies et al. | |
| 5,917,068 A | | 6/1999 | Barnicki et al. | |
| 6,344,573 B1 | * | 2/2002 | Rohr et al. | 554/19 |
| 2003/0120095 A1 | | 6/2003 | Rohr et al. | |
| 2003/0144536 A1 | | 7/2003 | Sonnler et al. | |

FOREIGN PATENT DOCUMENTS

| | | |
|---|---|---|
| GB | 380707 | 9/1932 |
| WO | WO 99/42471 | 8/1999 |
| WO | WO 01/25375 A2 | 4/2001 |
| WO | WO 01/83855 A1 | 11/2001 |

OTHER PUBLICATIONS

A.Koebner, "*Separation of Tall Oil Head Fraction Into Fatty Acids and Unsaponifiables*," Journal of Wood Chemistry and Technology, vol. 3, No. 4, (1983), pp. 413–420.

International Search Report for PCT/BR01/00071 (4 pages).

* cited by examiner

*Primary Examiner*—Deborah D. Carr
(74) *Attorney, Agent, or Firm*—Knobbe, Martens, Olson & Bear LLP

(57) ABSTRACT

Disclosed are processes for separating valuable products, including unsaponifiable materials, from any given matrix of raw materials that is mainly composed of saponifiable components and unsaponifiable components. Preferred methods include converting sodium or potassium soaps obtained from the saponification of a starting material into metallic soaps which have a lower melting point, and when melted, have viscosity sufficiently low to enable processing such as by distillation evaporation processes. Preferred raw materials include animal or vegetable products, as well as by-products, residues, and waste products from the processing of animal or vegetable products, such as from food processing, cellulose processing and the like. Valuable products which may be obtained by the disclosed processes include sterols, vitamins, flavonoids, and tocopherols.

37 Claims, No Drawings

PROCESS FOR SEPARATING UNSAPONIFIABLE VALUABLE PRODUCTS FROM RAW MATERIALS

RELATED APPLICATION INFORMATION

This application claims priority under 35 U.S.C. § 119(e) to Brazilian application no. PI0106522-0 filed Dec. 17, 2001.

BACKGROUND OF THE INVENTION

1. Field of the Invention

This invention relates to improved processes for the separation of unsaponifiable substances from raw materials including residues and by-products of the processing of animal and vegetable products, preferably by means of high vacuum distillation/evaporation. The unsaponifiable substances produced include liposoluble vitamins and provitamins, growth factors, animal and vegetable hormones, and other valuable products. Saponifiable substances may also be isolated by hydrolyzing the residues obtained from distillation/evaporation to produce higher quality fatty acids and other organic acids and/or a mixture of the same 2. Description of the Related Art The recovery of the unsaponifiable fraction of a raw material is of great commercial interest, due to the fact that, in many cases, the valuable products have beneficial properties such as vitamin activities (e.g. tocopherols (vitamin E), tocotrienols, carotenoids, vitamin A, vitamin K, vitamin D), cholesterol reducing properties (e.g. sterols, tocotrienols), anticarcinogenic properties (e.g. tocotrienols, sterols, lycopene, alphacarotene), use in biosynthesis (e.g. sterols for human hormone synthesis, vitamin D synthesis), and nutriceuticals. For instance, sterols can be used as a supplement in the diet of animals and humans as a means to lower cholesterol in the blood serum. There is also commercial interest in the use of sterols as emulsion stabilizers and/or viscosity modifiers, especially in cosmetic formulas. Moreover, tocopherols are another unsaponifiable that can be used as a dietary supplement and also has an important role in the cosmetic industry. Saponifiable components, such as fatty acids and rosin acids can also be isolated from tall oil and both, separately or mixed together, have commercial value and utility. Cholesterol can also be isolated as an unsaponifiable from a matrix that comes from animal based fatty acids, particularly found in the residue of the distillation of animal based fatty acids.

Most processes used nowadays to separate and concentrate unsaponifiable substances from residues and by-products of the processing of animal and vegetable products and other raw materials use solvents, taking advantage of the difference of solubility between unsaponifiable substances and the soap matrix. Some processes use the difference of volatility between volatile unsaponifiables and non-volatile fatty/rosin acids sodium or potassium salts or soaps to separate the compounds by means of high vacuum distillation/evaporation.

The solvents available at present are not sufficiently selective to obtain, through the current processes, a reasonable separation between the unsaponifiable components and the fatty acid, the rosin acid soaps. Due to this, it is often necessary to use more than one solvent, which in turn complicates and increases tremendously the cost of recovery and recycling of the same. Furthermore, solvents or solvent mixtures are used in very large proportions, when compared to the quantity of the material submitted for extraction and the solvents need additional processes for their removal and/or recycling in the extraction and pre-concentration process of the valuable products. The foregoing reasons make solvent-based processes harder and more expensive, resulting in a scarce and expensive final product.

In the case of separation by distillation, the difference between the boiling point of volatile products, such as unsaponifiable components, and the boiling point of the sodium and potassium organic acid soaps is so great that separation is theoretically possible at a high level of efficiency. However, a problem related to this separation technique is that the soaps have a very high melting point, close to the decomposition temperature of the sodium or potassium soaps (i.e. the sodium or potassium salts of fatty acids, rosin acids etc), and, when melted, these soaps form extremely viscous liquids. These two factors combine to make industrial handling difficult. Furthermore, while at the high temperature necessary to maintain their flow, these soaps are in permanent decomposition, compromising the separation output and the quality of the final product, as many of the unsaponifiable valuable products are heat sensitive.

SUMMARY OF THE INVENTION

In accordance with a preferred embodiment, there is provided a process for separating a valuable product from a raw material. The process begins by providing a raw material comprising one or more unsaponifiable compounds and one or more saponifiable compounds, wherein the one or more saponifiable compounds comprises one or more compounds in free acid and/or soap form. The process continues by reacting the saponifiable component comprising one or more compounds in free acid and/or soap form with a metal soap-forming compound to make a first product comprising metal soaps and one or more unsaponifiable compounds. The process further continues by subjecting a mixture of metal soaps and one or more unsaponifiable compounds to a distillation to form a distillate comprising at least a portion of the unsaponifiable compounds and a residue comprising the metal soaps.

Raw materials which may be used in the process include black liquor soap skimmings, tall oil soap, crude tall oil, tall oil pitch, sugarcane oil, residues from extraction, degumming, and refining of oils and fats, distillation residues of fatty acids and esters, deodorization distillates of vegetable oils, soybean oil, rice bran oil, shark liver oil, beef tallow, coffee oil, fish oil, cod liver oil, wheat germ oil, corn germ oil, palm oils, andiroba oils, and oil from tomato residues. Preferred metal soap-forming compounds include oxides, sulfates, hydroxides, carbonates, acetates and chlorides of zinc, iron, manganese, magnesium, calcium, copper, cobalt, lead and aluminum. Preferred valuable products obtained from the processes include provitamins, growth factors, flavonoids, sterols, lipoproteins, stilbenes, vitamins, fatty and wax alcohols, diterpenes, steroids, triterpenes, stilbenes, fatty acids, and rosin acids. Additional, specific valuable product which may be obtained include tocopherols, tocotrienols, carotenoids, vitamin A, vitamin K, vitamin D, squalane, oryzanol, lycopene, ceryl alcohol, cetyl alcohol, lignoceryl alcohol, behenyl alcohol, resin alcohols, resin aldehydes, labdanes, sitosterol, stigmastanol, campesterol, campestanol, cycloartenol, 3,5-stigmastadien-7-one, serratenediol, cholesterol, squalene; prenols, transpinosylvin dimethyl ether, abietic acid, dehydroabietic acid, neoabietic acid, isopimaric acid, pimaric acid, paulstric acid, oleic acid, linoleic acid, stearic acid, and palmitic acid.

Additional steps or substeps may be added to those described above. For example, the process may further comprise reacting the raw material with a sodium or potassium base to saponify free acid saponifiable compounds prior to the reacting to make the first product. Where a raw material comprises hydrolyzable esters, processes may further comprise hydrolyzing esters in the raw material upon exposure to the sodium or potassium base or by exposure to water under heat and high pressure.

Additional process steps can also include adding a mineral acid to at least a portion of the saponified compounds to form an acidulated mixture prior to the reacting to make the first product, which may be followed by subjecting the acidulated mixture to a distillation to produce a residue comprising one or more non-volatile compounds and a distillate comprising one or more unsaponifiable compounds and one or more saponifiable compounds prior to the reacting to make the first product.

In some embodiments, the first product is substantially dry after it is made. In other embodiments, the process further comprises treating the first product to remove water prior to the distilling to separate at least a portion of the unsaponifiable compounds from the metal soaps. Such removal of water may be effected by methods including thin-film evaporation, decantation and/or centrifugation.

In some embodiments, the process further comprises distilling or evaporating one or more compounds selected from the group consisting of lights, medium-lights, and water from the first product prior to the distilling to separate at least a portion of the unsaponifiable compounds from the metal soaps.

In preferred embodiments, the process further comprises subjecting the distillate comprising at least a portion of the unsaponifiable compounds to a subsequent distillation to form a second distillate and a second residue, thereby further purifying and/or separating the unsaponifiable compounds.

DETAILED DESCRIPTION OF THE PREFERRED EMBODIMENTS

The processes disclosed herein have solved the problems related to prior known processes for separating valuable products, including unsaponifiable materials, from any given matrix that is mainly composed of saponifiable components and unsaponifiable components. This is done by methods which include converting sodium or potassium soaps obtained from the saponification of a starting material into metallic soaps which have a lower melting point, and when melted, have low enough viscosity to enable handling even at industrial scale during the distillation/evaporation process. Suitable materials can be converted directly to the lower melting point, lower viscosity metallic soaps without first passing through the sodium/potassium salt or soap form, as discussed in more detail below. The process can also be applied to other fatty acid-containing raw materials containing "valuable products".

The raw materials, i.e. the starting materials comprising saponifiable and unsaponifiable materials used in this process are animal or vegetable oils and fats, by-products of the processing of the same, animal or vegetable by-products and residues, waste products from the processing of animal or vegetable products, or residues from the products of paper and cellulose industry. Preferred raw materials include: black liquor soap skimmings (BLSS) or tall oil soap obtained from cellulose processing and containing preferably about 3 to 7% by weight of sterols; crude tall oil (CTO) obtained from the acidulation of tall oil soap and containing preferably about 3 to 7% by weight of sterols and unsaponifiable content in the range of 8 to 20%; and tall oil pitch obtained as the residue from the distillation of tall oil and containing preferably about 8 to 20% by weight of sterols and unsaponifiable content of 30 to 50%. In these raw materials the unsaponifiable, valuable product to be separated comprises mainly sterols. Other suitable raw materials include: sugarcane oil; residues from extraction, degumming, and refining of oils and fats, such as: lecithins, neutralization soap stock, deodorization distillates and physical refining, "hot well" soap stocks, and winterization residues; distillation residues of fatty acids and esters (ethyl, methyl, butyl) of both animal or vegetable origin; deodorization distillates of vegetable oils, soybean oil, rice bran oil, shark liver oil, beef tallow, coffee oil, fish oil, cod liver oil; animal or vegetable oils and fats rich in unsaponifiable materials, such as: wheat germ oil, rice bran oil, corn germ oil, palm oils, andiroba oils, oil from tomato residues and other residues.

Furthermore, the disclosed methods can be used as the starting base to recover one or more individual compounds that form the defined starting matrix, whether the product or products of interest lie in the unsaponifiable components and/or the saponifiable components, because the two main fractions that make up the starting material, the saponifiable components, and the unsaponifiable components are both recovered separately. The unsaponifiable components include, but are not limited to, tocopherols, tocotrienols, carotenoids, vitamin A, vitamin K, vitamin D, lipoproteins, cholesterol, provitamins, growth factors, flavonoids, sterols, stilbenes, squalane, oryzanol and lycopene; and the saponifiable components include, but are not limited to, upgraded oils, fatty acids, fats, rosin acids, and esters.

The methods disclosed herein have utility in that they can be used to isolate a great variety of valuable products and materials from a wide range of starting materials. For example, if the starting material is tall oil soaps, then the unsaponifiable fractions will comprise the following compounds: fatty and wax alcohols including ceryl alcohol, cetyl alcohol, lignoceryl alcohol, and behenyl alcohol; diterpenes including hydrocarbons, resin alcohols, resin aldehydes, and labdanes; steroids including sitosterol, stigmastanol, campesterol, campestanol, cycloartenol, and 3,5-stigmastadien-7-one; triterpenes including serratenediol, squalene; and prenols; and stilbenes including trans-pinosylvin dimethyl ether. The saponifiable fraction of this same type of starting material will comprise the following: rosin acids including abietic acid, dehydroabietic acid, neoabietic acid, isopimaric acid, pimaric acid, and paulstric acid; and fatty acids including oleic acid, linoleic acid, stearic acid, and palmitic acid.

In preferred embodiments, the saponifiable fraction is recovered as a mixture of acids, after acidulation of the saponifiable fraction. In the case of tall oil soap or crude tall oil (CTO) as the starting material, one resulting product (from the saponifiable portion) is an upgraded crude tall oil, comprising a mixture of both rosin and fatty acids. The acid No. of this upgraded CTO is in the range of 170 to 180 and has a very low unsaponifiable content, as low as 3%. As a downstream process, the rosin and fatty acids can be separated by conventional fractional distillation or other suitable methods. If the starting material is tall oil pitch, comprising a mixture of one or more of rosin/fatty acids, esters of rosin/fatty acids, sterol esters, and neutral materials, the saponifiable fraction recovered by the use of the processes disclosed herein is then acidulated and it can be further subjected to distillation to result in a mixture of rosin and fatty acids that otherwise would have been lost in the pitch. This recovered product from tall oil pitch, has been shown to have an Acid No. as high as 180, with a rosin acids content of 40%, and as little as 1.2% unsaponifiables. This is a remarkable result considering that tall oil pitch may have an Acid No of 15 to 50 and an unsaponifiables content of 30–50%, indicating an efficiency of extraction of unsaponifiables as high as 95%. The results obtained are dependent in part on the quality of the crude tall oil (CTO) that is being subjected to distillation, and is also dependent on the distillation equipment and conditions under which the distillation takes place. Regardless, the processes according to preferred embodiments clearly show how they can be used to recover rosin/fatty acids that were otherwise lost in the fractionation process. Furthermore, in preferred embodiments, the processes also recover the unsaponifiable components, mainly sterols that were also present in the tall oil pitch.

With respect to the unsaponifiable fraction, in the case of the tall oil example, the unsaponifiables can be divided into three main unsaponifiable fractions. The first fraction is predominantly made up of lighter unsaponifiable materials, including, but not limited to, monoterpenes and sesquiterpenes. The second fraction is predominantly made of lights to medium lights, including, but not limited to, diterpenes and stilbenes. The third fraction is predominantly made of sterols, including, but not limited to, wax alcohols and triterpenes.

In addition to the sources mentioned above, there are a wide range of possible sources of starting material to be used in processes according to preferred embodiments, including by-products or waste products resulting from the processing of animal or vegetable products. For example, waste from processing of tomatoes, which may include the skins, is a suitable starting material which is a rich source of lycopene and other important nutritional compounds. Furthermore, individual families of compounds and/or individual compounds can be isolated separately from the two separated fractions. In the case of the saponifiable fraction different fatty and or rosin acids could be further separated by conventional fractional distillation or other chemical or physical separation processes. In the case of the unsaponifiable fraction, pure sterols can be isolated by crystallization from the crude sterols, a mixture of unsaponifiable components and sterols, which make up the unsaponifiable fraction. Other components may be further isolated by other chemical or physical separation methods.

Unless noted otherwise, all percentages in this disclosure are percentages by weight. The terms "soap" and "salt" are both used to describe the saponified acids in this application, because all soaps are salts, but it is also to be understood that not all salts are soaps.

Contrary to all these already known processes for the separation and concentration of unsaponifiables, the preferred processes disclosed herein do not require the use of solvents for the separation of the unsaponifiable fraction from the saponifiable fraction. An important limitation of solvent-based methods is that the solvents presently available are not sufficiently selective to obtain an efficient separation between the unsaponifiable fraction and the saponifiable fraction. As a result, many solvent extraction processes use a blend of more than one solvent, which then makes the solvent recovery process infeasible when trying to produce the aforementioned "valuable products" to the degree of quality and with the economics required by the market today. In addition, many extraction stages would also be required and a large solvent to feed ratio as well, all in which making the separation process not desirable.

Recognizing the difficulties described above for solvent-based methods, processes without the use of solvents were developed. Such processes describe the distillation and/or the evaporation of the unsaponifiable components from the saponifiable components in their sodium and/or potassium soap form. In theory, the separation that can be achieved between the unsaponifiable components and the saponifiable components, which are in sodium/potassium soap or salt form, should be high because sodium and/or potassium soaps are non-volatile and the unsaponifiables are volatile. However, in practice, such methods have failed because the melting point and viscosity of the soaps are extremely high. In addition, these metal soaps conduct heat poorly. All of these factors contribute to the impractically of handling these metal soaps. Another, important consideration is the lower thermal stability of these metal soaps, since they demand for higher operational temperatures. In conclusion, the actual separation of the saponifiable and unsaponifiable components becomes impracticable. For instance, if one uses a wiped film or a thin film evaporator to evaporate water and light unsaponifiable components (terpenes, stilbenes) from a sodium soap mixture, as drying proceeds and the lighter components come out of the soap mixture the viscosity and melting point of the soap mixture rises. As that happens, soap residue accumulates on the walls of the evaporator to a degree where the wiping system that spreads the feed material into a thin film will eventually fail. With such high melting point and high viscosity soaps, the use of a falling film is even less efficient and in some cases not possible in large scale for the same reason as described above. Some thin film manufactures do have the capability of designing special wiped film evaporators that can handle higher viscosity material, but the investment on such equipment is considerably higher and the quality of valuable products may also be considerably affected due to the more harsh conditions these special thin films operate. Furthermore, pumping of such materials also poses problems in that piping will become clogged as these soaps begin to accumulate in the pipelines. As a result of these difficulties, the quality of the recovered material would be inferior as dehydration and oxidation of the sterols would take place. Accordingly, industrial handling of such sodium/potassium soaps is largely infeasible.

If additional evaporations or distillations are called for, such as where the targeted distillates are the medium and heavy unsaponifiable components including the sterols and/or any other valuable products, one would expect to encounter the same or similar operating difficulties as noted above. Attempts to avoid these difficulties by the use of very high temperatures will cause a yield of lower quality products and lower separation efficiency in that such operational conditions are too harsh for the sterols in the unsaponifiable fraction and the fatty/rosin acids in the saponifiable fraction, both of which can be heat-sensitive. The higher distillation temperature can also decompose the heat-sensitive soaps, which would cause the fatty/rosin acids to distill off together with the unsaponifiable fraction, severely affecting the efficiency of separation process. Furthermore, the acidic material resulting from the decomposition of the sodium/potassium soap would form esters with the alcohols present in the unsaponifiable fraction, resulting in a low sterol recovery in the distillate.

One of the ways by which the methods presently disclosed solves the aforementioned problems of the prior art is by the use of reduced viscosity and lower melting point metal soaps for which industrial handling is feasible during pumping, distillation, discharging, etc. This may be done by transforming high melting point and highly viscous metal soaps which are formed by an initial saponification step or by other processing into metal soaps having a reduced melting point, lower viscosity and higher thermal stability by ion exchange or substitution in which a second metal which forms soaps having the desired properties is substituted for a first metal which forms soaps having properties which make handling difficult. The extent of the exchange of metals in the soap is preferably substantially complete or nearly complete.

The metal soaps having improved properties may also be formed directly by reacting the saponifiable components directly with compounds having metals which form soaps with the improved, desired properties. Metals which form metal soaps having desirable properties of reduced melting point and lower viscosity include, but are not limited to, those of zinc, iron, manganese, magnesium, calcium, copper, lead, cobalt and aluminum. Preferably those compounds are supplied as salts (i.e. compounds having a generally ionic bonding character between the metal and its counterion), including, but not limited to, oxides, sulfates, hydroxides, carbonates, acetates, and chlorides of the metals. Such compounds are often referred to herein as metal soap-forming compounds. Although compounds which contain sodium and/or potassium as their only metal may also form soaps, they are not considered within the definition because the soaps that they form do not have the desired melting and viscosity properties. Whether the lower melting, lower viscosity soap is formed directly or by exchange, it is preferred that the vast majority of the metals of the soap (i.e. those which are the counterion of the acid) be those which form lower melting, lower viscosity soaps. Nonetheless, a small quantity, preferably less than about 10%, of sodium and/or potassium soap in the mixture does not appear to negatively affect the properties of the soap. Therefore a 100% conversion of sodium soap to a different metal is not required, yet the benefit of lower viscosity and melting point can already be enjoyed. Though if more than about 10% of the metal soap is Na-soap, then viscosity and higher melting point begins to play a role again.

Methods may utilize compounds having one or more metals such that the reduced melting point metal soap can include, but is not limited to, magnesium soap, zinc soap, iron soap, manganese soap, calcium soap, aluminum soap, copper soap, cobalt soap, lead soap, potassium soap, and/or a blend of one or more metal soaps including, but not limited to, sodium-manganese-iron soap, aluminum-magnesium-sodium soap, iron-zinc-sodium soap, zinc-magnesium-potassium soap, zinc-sodium soap, magnesium-sodium soap, magnesium-potassium soap, zinc-potassium soap, manganese-sodium soap, zinc-calcium soap, copper-sodium soap, lead-potassium soap, and cobalt-potassium soap. Some metal soap blends maybe preferred over others depending on the performance of the metal soap during distillation and also by the economical feasibility of the soap making part of this process.

The metal soaps formed by the metal soap-forming compounds ideally are thermally stable at processing temperatures that are at or somewhat above their melting point, and also have a viscosity low enough to allow for ease in processing when at such temperatures. Soaps having lower melting points are preferred, however, the relative gain in ease of processing and yield from one lower melting point soap to another having an even lower melting point may, in many circumstances, need to be balanced against factors such as thermal stability, cost, availability, environmental concerns and the like, for a given process.

It is also worth noting that an ester can be hydrolyzed into its acidic component, which is saponifiable, and its alcoholic component, which is unsaponifiable. Therefore, the alcoholic component of an ester can be recovered in the unsaponifiable fractions using the methods disclosed herein. The distinction is important since, depending on what conditions were used to recover the starting material, products of interest may be found in ester form. For example, sterols in tall oil pitch will be found predominantly in ester form. Accordingly, in such situations it is preferred to treat the starting material to hydrolyze the sterol-esters into free sterols, which correspond to the alcoholic component of the ester and are unsaponifiable. The other liberated component of the sterol-ester is an acidic component and is saponifiable. The hydrolysis of esters may be carried out whenever esters are present in significant amounts in the starting material and/or when a compound of interest is one of the components of the sterol-ester. This pre-treatment of the starting material will result in higher amounts of unsaponifiable components recovered and in higher amounts of acidic, saponifiable components recovered.

Once the reduced melting point and lower viscosity metal soap is prepared, it may require drying to remove excess water present in the soap mixture. This is especially preferred in those cases where, after the soap mixture is prepared, the quantity of water present in the soap mixture is large enough as to interfere with subsequent distillation/evaporation operations to separate the unsaponifiable and saponifiable components. This drying may be effected by the use of distillation apparatus, application of heat to speed natural evaporation, exposure to reduced pressure or vacuum preferably with heating, centrifugation, decantation, and any other method or apparatus presently known or later developed which can remove water from a material of similar nature to the soap mixtures.

Following preparation and drying, if needed, the reduced melting point and lower viscosity metal soap forms the feed material to the high vacuum distillation units. In preferred embodiments, the extraction of the unsaponifiable components is divided into multiple stages which are performed sequentially, which may serve to confer benefits on the processes. For example, since a variety of valuable products can be found in the unsaponifiable portion of a given matrix, by separating the different unsaponifiable components by their respective volatility using multiple distillation stages, different valuable products maybe isolated in different distillates. For example, stilbenes have lower boiling point than sterols, such that the lighter fractions will be richer in stilbenes, while the heavier fractions will be richer in sterols. Similarly, if the lighter components are removed sequentially, each subsequent distillation step can operate efficiently at a higher vacuum and lower distillation temperature, providing for better stability of the metal soap and allowing for the recovery of higher quality unsaponifiable components. In the case of crude sterols (a mixture of sterols and other unsaponifiables) for crystallization and production of pure sterols, higher yield and purity is obtained with greater ease, due to the higher quality of crude sterols being produced by the use of preferred embodiments as described herein. The crude sterols produced by methods according to preferred embodiments have a lower content of degraded and oxidized sterols and lower content of acidic components, which inhibits crystallization of pure sterols.

Accordingly, the process may comprise one, two, three, or even more distillation steps, depending upon factors which may include the starting material, the degree of separation of products desired, the degree of purity of products desired, and/or the identity of products desired, as noted above. The apparatus used for distillation is preferably a falling film, thin-film, or a molecular distillation apparatus, although other suitable apparatus and techniques may also be used. For example, in the case of CTO or tall oil soap as the chosen starting material, a preferred method comprises three distillation steps: a first resulting in the removal of residual humidity and light unsaponifiable components; a second resulting in the removal of light to medium light unsaponifiable components; and a third which extracts the remaining fraction of the unsaponifiable components, comprised mainly of sterols. Following a given distillation, subsequent distillations may begin with either the distillate or residue from the earlier distillation, or both the residue and the distillate may be separately further distilled. Such subsequent distillations may be used to further improve the quality and purity of the materials. Finally, a distillate or residue containing a desired material or valuable product may be further purified by techniques including chromatography, filtration, and crystallization. Other suitable chemical and physical techniques of separation may be used to obtain purified and isolated compounds from a distillate or residue, including those known in the art. In a preferred embodiment, a final crystallization step can yield a final product of sterols at a concentration (purity) of 90 to 99%.

As noted above, the methods disclosed herein comprise multiple steps. Which steps are used will vary depending on several factors, including, but not limited to, the identities of the starting material and desired target(s) and valuable product(s). The variations between preferred processes seem to occur most frequently in the steps which comprise the preparation and drying of the mixture comprising metal soap having reduced viscosity and melting point that forms the feed material for the first distillation step (in which lights and residual humidity is removed), although variations may, and do, occur elsewhere in the process.

Thus, disclosed are processes for separating one or more valuable products from a raw material. Although the primary portion of the process begins with the formation of metal soaps having a reduced melting point, there are several routes of getting to that point. For some raw materials, it is desired to perform one or more steps of pre-treatment with regard to cleaning up the material for further processing. Such cleaning methods include, but are not limited to, rinsing, washing, filtering, and decanting. For example, BLSS received from papermills oftentimes has solid materials which should be filtered out, and may also benefit from washings as with water and caustic solution to remove other contaminants.

If a material comprises sterol esters, it may be desired to hydrolyze the sterol esters before proceeding with making the reduced melting point soap mixture. This pretreatment hydrolysis of sterol esters may be done by any suitable method which results in their hydrolysis. One preferred method is to combine the sterol-ester-containing material with water and hydrolyze the esters under applied pressure at an elevated temperature. One suitable set of conditions for hydrolysis is a combination of a pressure of about 15–50 bar and a temperature of about 200–260° C., including about 220–230° C. Another preferred method of hydrolysis is to combine the sterol-ester-containing material with a strong base, including but not limited to NaOH and KOH, at an elevated temperature, preferably over about 80° C., including in the range of about 90–120° C., optionally with added pressure and constant stirring. This second method has the added benefit of both hydrolyzing and saponifying the material.

If a raw material has been received as a sodium or potassium soap, or if in a pretreatment step it is converted to a sodium or potassium soap (e.g. hydrolysis in the presence of NaOH or KOH), it is then converted to metal soaps having a reduced melting point by reacting the sodium or potassium soaps with at least one metal soap-forming compound. One suitable set of reaction conditions includes heating the mixture to a temperature in the range of about 100–200° C., although other sets of conditions may also be used. Preferred metal soap-forming compounds include salts and bases of zinc, iron, manganese, magnesium, calcium, lead or aluminum, preferably oxides, sulfates, hydroxides, carbonates, acetates, and/or chlorides of zinc, iron, manganese, magnesium, calcium, lead and/or aluminum. Other metal compounds that form fluid metal soaps at temperatures below 180° C. are also suitable. This reaction is carried out by ion exchange with the metal salts, preferably the sulfates or chlorides, transforming sodium and potassium soaps into metal soaps with lower melting points. The exchange of metals may be partial such that as much as about 30% sodium or potassium soaps remains, including about 5–20%, or it may be complete or substantially (i.e. less than about 5% sodium or potassium salts) complete.

If the saponifiable portion of the raw material, whether directly or following any pretreatment, comprises primarily free acids (or a substantial amount of free acids), there are at least two preferred routes to the metal soaps having a reduced melting point. One option is to carry out the reaction under fusion conditions directly neutralizing the acidic components totally or partially by allowing one or more appropriate metal salts, preferably oxides, to react with the fatty acid, rosin acid, or any organic acid in the material to form metal soaps having a reduced melting point and lower viscosity. In this same process, any compounds which were already saponified may also be converted to soaps of the new metal(s). A second option is to first react the acids with a potassium or sodium compound, preferably KOH or NaOH, and then react the saponified compounds with one or more appropriate metal salts to form the metal soaps having a reduced melting point as noted in the previous paragraph. The initial saponification to make potassium or sodium soaps, in this second disclosed option; may be done under a variety of conditions. Suitable conditions include use of solutions of the potassium or sodium base, preferably their respective hydroxides, at concentrations of about 40–60% and at a temperature of about 65–120° C. Other temperatures and concentrations may be used, keeping in mind that use of dilute solutions will require the later removal of larger amounts of excess water as compared to more concentrated solutions. Neat or solid bases may also be used, and may be especially useful where there is already a relatively large quantity of water in the mixture being saponified, or at least an amount of water sufficient to solvate the needed quantity of base. Following the conversion to sodium and/or potassium soap conversion, the next step is to carry out the metal exchange reaction as already described.

At this point, the raw material has been converted into a material comprising a saponifiable component comprising metal soaps having a reduced melting point and viscosity and an unsaponifiable component. Drying of the material is optionally performed to remove excess water and/or light to medium light unsaponifiables. Drying is especially preferred in cases where the water content of the material is high, that is greater or equal to about 5 to 50%, although it should be noted that for some preferred apparatus used in further processing, including high vacuum distillation systems used to separate light unsaponifiables and residual humidity, it is preferred that the water content be as low as about 1% or even less. As for operating at 0.01–0.001 mbar during the separation of the unsaponifiables, it is preferred that the water content be as low as 0.1%. Drying may be performed by any suitable method for extracting water from a semi-solid or viscous material, including, but not limited to, application of a vacuum or reduced pressure (either with or without added heat), rotovaporation, distillation (preferably under vacuum), decantation, and use of a centrifuge and/or a combination of these processes. More than one method may be used to bring the material to a desired level of dryness. In cases where there is a great deal of water, bulk techniques such as centrifugation are a preferred choice on the basis of economics. A thin film evaporator may be used for removal of smaller quantities of water, with one set of suitable conditions being that of a temperature in the range of about 150–240° C. and a pressure in the range of about 3–600 mbar, noting that for larger quantities of water, use of pressures toward the higher end of the example range noted above would be preferred, and that for lower quantities of water, pressures at the lower end of the example range, and below, would be preferred. In other cases, where there is a very small amount of water, whether because there was a small amount of water following metal soap formation or whether the material had been dried in a previous drying step, distillation under vacuum can be used to both remove the remaining humidity and to remove the very light unsaponifiable fractions. Preferred conditions for removal of residual humidity and light to medium light compounds are temperatures in the range of about 150–230° C. and pressures of about 0.1–40 mbar.

At this point, the material comprises dried metal soaps having a reduced melting point and viscosity. The next step or steps involve the separation of the unsaponifiable and saponifiable components (initially from each other, but optionally later for separation of different fractions within a given category of material) and are preferably carried out in a high vacuum evaporator or distillation apparatus. Suitable conditions include temperatures in the range of about 100° C. to 350° C. and pressures in the range of about 5. mbar to $1\times10^{-3}$ mbar. This distillation/evaporation can be carried out in one or more stages, according to the desired degree of concentration and/or separation. Oftentimes, the first distillation is performed to practically fully separate the saponifiable and unsaponifiable materials, which may then be further processed separately, if desired. However, it is possible to carry out more than one distillation in which the starting material comprises reasonable quantities (viewed in light of their totals in the raw material) of both unsaponifiable material and saponifiable material. As compared to those distillations which are used to separate different fractions of unsaponifiable materials, distillations in which the aim is to separate the unsaponifiables from the saponifiables are preferably run at a higher temperature and the lowest possible pressure to ensure the best separation, remembering that the lower the pressure, the lower the distillation temperature which may be used to achieve the same or similar degree of separation, but in a manner in which degradation of the materials is minimized. Other conditions may be used to achieve satisfactory results, but the low pressure and low temperature conditions will very likely achieve better yields. It should be further considered that low temperature as indicated above, when used in reference to a distillation step for the separation of the unsaponifiable from the saponifiable components, is in relative terms; for example, 270° C. can be considered a low distillation temperature when compared to distillation temperatures above 300° C. It should be noted, however, that in the processes disclosed herein, as in many types of processes, each user will determine what the best balance is between the many factors involved in the process including time, cost, process optimization, operational ease and desired yield.

Following one or more distillation/evaporation processes, the separated materials may be further processed such as to enhance purity, place the compounds in a form which is commercially desired, or other reasons. Additional purification may be done by crystallization, chromatography, or other known methods. One may even desire to use differential solubility and the use of solvents to further separate or purify at this stage. Use of solvents at this stage is not as disadvantageous as it is at other stages, as discussed previously, because of the smaller amount of material carrying a higher concentration of the valuable products and the greater simplicity of the mixture (fewer components). In the case of saponifiable materials, acidulation or acidification, such as with an inorganic acid, may be done to return all or some of the compounds to their free acid form. Following conversion to free acid form, the saponifiable materials may also be further processed using techniques discussed above, including, but not limited to, distillation to obtain preferred fractions, chromatography, and the like.

Although thin-film evaporators, molecular distillation columns, and short path evaporators are mentioned specifically in this description for use in distillation/evaporation of various mixtures, it should be noted that any suitable apparatus may be used for these steps. Non-vacuum equipment and conditions may also be used, but are disfavored because the higher temperatures that they require by virtue of operating at ambient pressure will very likely cause decomposition of the soaps and valuable products. Also it is recognized that the lower the pressure, the lower the temperature needed to distill a given fraction. Accordingly, the preferred ranges stated herein are merely guidelines, and may be altered to fit other needs, setups, equipment and the like as is within the abilities of one skilled in the art.

An increase in fluidity and decrease of the melting point of very viscous materials, like the tall oil pitch, can also be obtained by blending the material with other unsaponifiable residues having lower viscosity, before or after the saponification. Lower viscosity residues include vegetable oil neutralization soapstock, tall oil black liquor soap skimming, the mother liquor residue from the crystallization after the solvent has been recovered (which may contain 8–20% sterols) and other residues or products, which after soap formation, become fluid at a temperature below 200° C.

The presence of glycerides (di- or triglycerides) or sucrose-polymers can also contribute to decrease the melting point and increase the fluidity of some materials like tall oil pitch soap (tall oil distillation residue). One may also add some viscosity modifier to the soap or add some fatty acids to the residue of the main distillation step to aid in the industrial handling.

It should be noted that, although the descriptions below recite use of sodium hydroxide and potassium hydroxide as the material used for the initial saponification, it is merely a preferred material and its use should not be read to exclude use of other strong base materials for this purpose. The use of other strong bases in saponification is presently contemplated. Sodium hydroxide is a preferred material for several reasons including its low cost, high availability, and chemical properties.

Similarly, the disclosure of the use of certain chemical compounds should not be read to exclude the use of other chemicals which have similar properties. The conditions including temperatures and pressures, reagents and the form and concentrations thereof, apparatus, techniques, and other details presented in this description, including in the general descriptions above and below and the examples appearing below, are preferred conditions, ranges, materials, techniques and apparatus, whether this is explicitly stated in each particular instance or not. Other suitable conditions, materials, apparatus and techniques may be substituted therefor by a skilled artisan without deviating from the spirit of the disclosure.

Crude Tall Oil as Starting Material

In general terms, a preferred process for removing the unsaponifiables from crude tall oil (CTO) proceeds as described below. First, the CTO is saponified with NaOH, preferably in the form of a solution having a concentration on the order of about 40%–50%, at a temperature of preferably about 70–105° C. to form Na-soap or Na salts from the rosin/fatty acids present in the CTO. The Na-soap or Na-salt is then totally or partially reacted with one or more metal salts, preferably metal sulfates, metal oxides, metal hydroxides, metal acetates, or metal carbonates, including, but not limited to zinc sulfate ($ZnSO_4$) and magnesium sulfate ($MgSO_4$), to form a lower melting point and lower viscosity metal soap. The resulting metal soap mixture generally has a water content of about 40–50%. The metal soap mixture is then washed with more water and part of the total water is separated out by the use of a centrifugation process. Because the viscosity of the soap mixture rises dramatically upon water removal, the metal soap mixture following centrifugation generally has a residual water content of about 15–20%. The metal soap mixture containing about 15–20% water, is then fed into a thin-film evaporator or a falling film evaporator in order to dry the metal soap mixture so that only residual levels of humidity remain in the metal soap mixture. The thin-film evaporator is preferably run at a temperature of about 180–230° C. and a pressure of about 10–500 mbar. The exact conditions to use depend in part upon the actual metal soap used and may be determined by reviewing the properties of the metal salt or by routine experimentation. The dried metal soap mixture is then ready for the next step.

Alternatively, the product of the above paragraph may be obtained by a process comprising fewer steps. First, CTO is neutralized directly with a metal oxide or metal hydroxide or a combination of both, wherein at least some of the metal is one or more of the metals listed as providing soaps and salts having lower melting points. First, a well dispersed mixture of the CTO and the metal oxide and/or metal hydroxide is made, and then the mixture is placed under vacuum at a temperature of about 105–200° C. for reaction to take place. Reaction time is generally in the range of about 30 min. to about 3 hrs, depending on factors including the type of reactor, mixing system, vacuum, temperature, and the type of metal soap being produced that are used. The product of the reaction is a substantially dry metal soap mixture which is then ready for the next step.

The dry metal soap mixture is fed into a thin-film evaporator to remove light to medium-light components and some or all of the residual humidity. Operating conditions utilized are preferably a temperature of about 150–230° C. and a pressure of about 0.1–40 mbar. The distillate yield is generally in the range of about 1–6% (lighter material).

The metal soap mixture without lights (the residue from the above distillation) is fed into a molecular distillation column or short-path evaporator, which is basically the same type of equipment going by different names. In this step, the sterols and the rest of the unsaponifiables are distilled. Operating conditions utilized are preferably a temperature of about 240–300° C. and a pressure of about 0.001–0.1 mbar. The distillate yield is generally in the range of about 7–15% (sterol rich fraction). The residue is the remaining 85–93% of the material left after the distillates have been separated. The residue may be acidulated with a mineral acid to yield the fatty/rosin acids with low unsaponifiables, the upgraded CTO, which is then subjected to another distillation to yield a superior quality DTO (Distilled Tall Oil), or it could be fractionated to separate the fatty from the rosin acids. It should be noted that the fractionation of fatty acids from rosin acids may begin with an upgraded CTO or it may begin with an upgraded DTO.

The distillate from above, which contains the sterols, optionally undergoes further purification. Further purification may be required depending on the quality of the first slurry or distillate. One option for further purification is to subject the material of the distillate to another distillation, such as by using a short-path evaporator. Conditions used for the short path evaporator are a temperature of about 110–160° C. and a pressure of about 0.001–0.01 mbar, but may vary depending upon the actual contents of the distillate. The distillate fraction (of the re-distilled material) generally yields about 15–30% and is rich in remaining acid components and lighter unsaponifiable components. The residue portion of the re-distilled material generally has a yield of about 70–85% and is rich in sterols, with concentrations ranging from 35–50% sterols. Yet another distillation in a short-path evaporator may be carried out at a temperature in range of about 250–300° C. and at pressure in the range of about 0.001–0.01 mbar. Such additional distillation may be desired in order to improve the already satisfactory color of the previous slurry.

Other separation and/or purification methods may also be used for the optional purification, including other distillation techniques and chromatographic techniques. Furthermore, in cases where the slurry contains a higher acid content, which inhibits the crystallization process, it may be desired that the slurry be neutralized before proceeding. The Acid Number can be neutralized with a metal oxide and/or a metal hydroxide to form a metal soap mixture with a very high content of sterols. The Acid Number, as is known in the art, has units of mg of KOH/g of sample and provides a value on the bulk acidity of the substance, or otherwise put, provides a value of the amount of KOH base needed to neutralize the material. Using the same principles for the distillation operation which begins with metal soap mixture without lights described immediately above, the material may be subjected to a distillation in a short-path evaporator in which operating conditions utilized are preferably a temperature of about 240–300° C. and a pressure of about 0.001–0.1 mbar. The distillate generally has a yield of about 80–90% (containing about 35–50% sterols) and is in a form to undergo a final crystallization, if desired.

Once a high quality slurry is obtained, whether it is the original distillate or the residue from the re-distillation of the original distillate, a crystallization, as discussed in more detail below in the section Crystallization of Sterols, may be performed to purify the sterols to the desired purity and yield.

Tall Oil Pitch as Starting Material

In general terms, preferred processes for removing the unsaponifiables from tall oil pitch proceeds as described below. There are several possible methods to transform the tall oil pitch into the dry metal soap mixture which is used for the later portions of the process. Although five methods are presented below, it is to be understood that one skilled in the art may "mix and match" the steps appearing below to create other embodiments of the disclosed methods.

Tall oil pitch ("pitch") contains sterols in their ester form; therefore it is desirable both hydrolyze the sterol esters and saponify the pitch by combining the pitch with a 50% solution of NaOH at temperatures in the range of about 95–115° C., preferably under constant stirring and added pressure, for a period of time sufficient for the sterols to be hydrolyzed, usually about 1 to 2 hrs. At completion, the mixture comprises rosin/fatty acids in their Na-soap and/or Na salts form and free sterols in alcoholic form.

The Na-soap or Na-salt is then totally or partially reacted with one or more metal salts or bases preferably selected from metal sulfates, metal oxides, metal hydroxides, metal acetates, or metal carbonates, to form a lower melting point and lower viscosity metal soap mixture. The resulting metal soap mixture generally has a water content of about 40–50%. The metal soap mixture is then washed with more water and part of the total water is separated out by the use of a centrifugation process. Because the viscosity of the soap mixture rises dramatically upon water removal, the metal soap mixture following centrifugation generally has a residual water content of about 15–20%. The metal soap mixture containing about 15–20% water, is then fed into a thin-film evaporator or a falling film evaporator in order to dry the metal soap mixture so that only residual levels of humidity remain in the metal soap mixture. The thin-film evaporator is preferably run at a temperature of about 180–230° C. and a pressure of about 10–500 mbar. The exact conditions to use depend in part upon the actual metal soap used and may be determined by reviewing the properties of the metal salt or by routine experimentation. The dried metal soap mixture is then ready for the next step.

In a second method of obtaining the dry metal soap mixture, tall oil pitch is combined with a 50% solution of NaOH at temperatures in the range of about 95–115° C., preferably under constant stirring and added pressure, for a period of time sufficient for the sterols to be hydrolyzed. At completion, the mixture comprises rosin/fatty acids in their Na-soap and/or Na salts form and free sterols in alcoholic form. This mixture can be acidulated with a light concentration of mineral acid solution to yield a mixture composed of fatty/rosin acids and free-sterols.

The above mixture, having an acid number in the range of 90–100 is neutralized directly by mixing it with one or more metal salts or bases preferably metal sulfates, metal oxides, metal hydroxides, metal acetates or metal carbonates, including combinations thereof, preferably metal oxides and metal hydroxides and then placing the mixture under vacuum at a temperature of about 105–200° C. for reaction to take place. The product of the reaction is a substantially dry metal soap mixture which is then ready for the next step.

In a third method of obtaining the dry metal soap mixture, tall oil pitch is combined with a 50% solution of NaOH at temperatures in the range of about 95–115° C., preferably under constant stirring and added pressure, for a period of time sufficient for the sterols to be hydrolyzed. At completion, the mixture comprises rosin/fatty acids in their Na-soap and/or Na salts form and free sterols in alcoholic form. This mixture can be acidulated with a light concentration of mineral acid solution to yield a mixture composed of fatty/rosin acids and free-sterols.

The above mixture is then fed into a short path still to distill out the fatty/rosin acids and most unsaponifiables including the free-sterols. The conditions for the distillation preferably include a temperature of about 270–320° C. and a pressure of about 0.001–0.1 mbar. The yield of the distillate is generally in the range of about 65–80% and preferably contains substantially all fatty/rosin acids and free-sterols. The yield of the residue is generally in the range of 20–35% and contains a heavier dimerized material that normally contributes a lot to the high viscosity of tall oil pitch. With this heavier, dimerized material out of the way, the distillate may then be neutralized to form the metal soap.

The above material, having an acid number preferably in the range of 90–120 is neutralized directly by mixing it with one or more metal salts or bases preferably metal sulfates, metal oxides, metal hydroxides, metal acetates or metal carbonates, including combinations thereof, and then placing the neutralization mixture under vacuum at a temperature of about 105–200° C. for reaction to take place. The product of the reaction is a substantially dry metal soap mixture which is then ready for the next step.

In a fourth method, sterol esters in the tall oil pitch are hydrolyzed in a high-pressure vessel with water at temperatures of about 250–280° C. The resulting mixture comprises sterols in alcoholic form and fatty/rosin acids.

The above mixture is then fed into a short path still to distill out the fatty/rosin acids and most unsaponifiables including the free-sterols. The conditions for the distillation preferably include a temperature of about 270–320° C. and a pressure of about 0.001–0.1 mbar. The yield of the distillate is generally in the range of about 65–80% and preferably contains substantially all fatty/rosin acids and free-sterols. The yield of the residue is generally in the range of 20–35% and contains a heavier dimerized material that normally contributes a lot to the high viscosity of tall oil pitch. With this heavier, dimerized material out of the way, the distillate is then neutralized to form the metal soap mixture.

The above material, preferably having an acid number in the range of 90–120 is neutralized directly by mixing it with one or more metal salts or bases including metal sulfates, metal oxides, metal hydroxides, metal acetates or metal carbonates, including combinations thereof, and then placing the neutralization mixture under vacuum at a temperature of about 105–200° C. for reaction to take place. The product of the reaction is a substantially dry metal soap mixture which is then ready for the next step.

In a fifth method of obtaining a dry metal soap mixture, sterol esters in the tall oil pitch are hydrolyzed in a high-pressure vessel with water at temperatures of about 250–280° C. The resulting mixture comprises sterols in alcoholic form and fatty/rosin acids.

The above material, preferably having an acid number in the range of 90–100 is neutralized directly by mixing it with one or more metal salts or bases, preferably metal sulfates, metal oxides, metal hydroxides, metal acetates or metal carbonates, including combinations thereof, and then placing the neutralization mixture under vacuum at a temperature of about 105–200° C. for reaction to take place. The product of the reaction is a substantially dry metal soap mixture which is then ready for the next step.

The five methods of obtaining the dry metal soap mixture from tall oil pitch discussed above, as well as others using similar methods, are processed similarly from this point on. The dry metal soap mixture is fed into a thin-film evaporator to remove light to medium-light components and some or all of the residual humidity. Operating conditions utilized are preferably a temperature of about 150–200° C. and a pressure of about 0.1–40 mbar. The distillate yield is generally in the range of about 1–2%. This yield is lower than what is found with CTO as a starting material because there are generally no light materials and fewer medium light materials in the pitch.

The metal soap mixture without lights (the residue from the above distillation) is fed into a molecular distillation column or short-path evaporator. In this step, the sterols and other unsaponifiables are distilled. Operating conditions utilized are preferably a temperature of about 240–300° C. and a pressure of about 0.001–0.1 mbar. The distillate yield is generally in the range of about 25–30%, about 40–50% of which is sterols. The remaining 70–75% of the material left after the distillates have been separated is the residue. The residue may be acidulated with a mineral acid to yield the fatty/rosin acids with low unsaponifiables, which may be subjected to another distillation to yield higher quality fatty/rosin acids that were lost during the de-pitching process of fractionating tall oil.

The distillate from above, which contains the sterols, optionally undergoes further purification. Further purification may be required depending on the quality of the first slurry or distillate. One option for further purification is to re-distill the distillate (i.e. subject the distillate to a further distillation), such as by using a short-path evaporator. Conditions used for the short path evaporator are a temperature of about 110–160° C. and a pressure of about 0.001–0.01 mbar, but may vary depending upon the actual contents of the distillate. The distillate fraction (following re-distillation) generally yields about 10–20% and is rich in remaining acid components and lighter unsaponifiable components. The residue portion following re-distillation generally has a yield of about 80–90%, about 45–65% of which is sterols.

Other separation and/or purification methods may also be used for optional purification, including other distillation techniques and chromatographic techniques. Acidification followed by distillation, such as is discussed above with regard to optional purification for CTO may also be done in cases where the slurry contains a higher acid content.

Once a high quality slurry is obtained, whether it is the original distillate or the residue from re-distilling the original distillate, a crystallization, as discussed in more detail below in the section Crystallization of Sterols, may be performed to purify the sterols.

Deodorizer Distillate of Sova (DDOS) as Starting Material

In general terms, preferred processes for removing the unsaponifiables from DDOS proceeds as described below. In working with Soya-derived material, as part of the unsaponifiables, the presence of tocopherols must be considered. There are several possible methods for the transformation of the DDOS into the dry metal soap mixture which is used for the later portions of the process. Although three methods are presented below, it is to be understood that one skilled in the art may "mix and match" the steps appearing below to create other embodiments of the disclosed methods.

In a first method, the deodorizer distillate is saponified with a 50% solution of NaOH at a temperature in the range of about 70–105° C. The saponification of the DDOS results in the formation of Na-soap and/or Na-salts of the fatty acids present in the initial material and also the hydrolysis of any esters, including sterol esters. This will result in a higher yield in the recovery of fatty acids, tocopherols and sterols.

The Na-soap or Na-salt is then totally or partially reacted with one or more metal salts or bases, preferably metal sulfates, metal oxides, metal hydroxides, metal acetates or metal carbonates, to form a lower melting point and lower viscosity metal soap mixture (which may be referred to as just metal soap). The resulting metal soap mixture generally has a water content of about 40–50%. The metal soap mixture is then washed with more water and part of the total water is separated out by the use of a centrifugation process. Because the viscosity of the soap mixture rises dramatically upon water removal, the metal soap mixture following centrifugation generally has a residual water content of about 15–20%. The metal soap mixture containing about 15–20% water, is then fed into a thin-film evaporator in order to dry the metal soap mixture so that only residual levels of humidity remain in the metal soap mixture. The thin-film evaporator is preferably run at a temperature of about 180–230° C. and a pressure of about 10–500 mbar. The exact conditions to use depend in part upon the actual metal soap used and may be determined by reviewing the properties of the metal salt or by routine experimentation. The dried metal soap is then ready for the next step.

In a second method, the deodorizer distillate is saponified with a 50% solution of NaOH at a temperature in the range of about 70–105° C. The saponification of the DDOS results in the formation of Na-soap and/or Na-salts of the fatty acids present in the initial material and also the hydrolysis of any esters, including sterol esters.

The above mixture is then preferably acidulated with a solution of mineral acid having a low acid concentration to yield a mixture comprising fatty acids, free-sterols, tocopherols and other unsaponifiable components.

The above mixture, which preferably has an acid number in the range of about 90–100 is neutralized directly with a metal oxide or metal hydroxide or a combination of both. Other metal bases may be used as well. The materials are first well combined and then the reaction preferably takes place at a temperature of about 105–200° C. under reduced pressure. A dry metal soap mixture is thus formed, which is ready for the next step.

In a third method of obtaining the dry metal soap mixture, the DDOS is subjected to a distillation, preferably in a molecular distillation apparatus and at a temperature of about 290–310° C. and a pressure range of about 0.01 to 0.001 mbar. The distillation occurs with the DDOS "as is" in order to leave in the residue the neutral oil and polymers which generally form about 30% of the DDOS and are too heavy to be distilled. The distillate from this distillation comprises a mix of fatty acids and unsaponifiable materials.

The above mixture, which preferably has an acid number in the range of about 95–120 is neutralized directly with a metal oxide or metal hydroxide or a combination of both. Other metal bases may be used as well. The materials are first well combined and then the reaction preferably takes place at a temperature of about 105–200° C. under reduced pressure. A dry metal soap mixture is thus formed, which is ready for the next step.

In a fourth method, the deodorizer distillate is saponified with a 50% solution of NaOH at a temperature in the range of about 70–105° C. The saponification of the DDOS results in the formation of Na-soap and/or Na-salts of the fatty acids present in the initial material and also the hydrolysis of any esters, including sterol esters.

The above mixture is then preferably acidulated with a solution of mineral acid having a low acid concentration to yield a mixture comprising fatty acids, free-sterols, tocopherols and other unsaponifiable components.

The above ester-free deodorizer distillate is subjected to a distillation, preferably in a molecular distillation apparatus and at a temperature of about 290–310° C. and a pressure range of about 0.01 to 0.001 mbar. The distillation occurs with the DDOS "as is" in order to leave in the residue the neutral oil and polymers which generally form about 30% of the DDOS and are too heavy to be distilled. The distillate from this distillation generally comprises a mix of fatty acids and unsaponifiable materials.

The above mixture, which preferably has an acid number in the range of about 95–120 is neutralized directly with a metal oxide or metal hydroxide or a combination of both. Other metal bases may be used as well. The materials are first well combined and then the reaction preferably takes place at a temperature of about 105–200° C. under reduced pressure. A dry metal soap mixture is thus formed, which is ready for the next step.

The four methods of obtaining the dry metal soap mixture from DDOS discussed above, as well as others using similar methods, are processed similarly from this point on. The dry metal soap mixture is fed into a thin-film evaporator to remove light to medium-light components and some or all of the residual humidity. Operating conditions utilized are preferably a temperature of about 150–215° C. and a pressure of about 0.1–40 mbar. The distillate yield is generally in the range of about 3–7%.

The metal soap mixture without lights (the residue from the above distillation) is fed into a molecular distillation column or short-path evaporator. In this step, the sterols, tocopherols, and other unsaponifiables are distilled. Operating conditions utilized are preferably a temperature of about 240–300° C. and a pressure of about 0.001–0.1 mbar. The distillate yield is generally in the range of about 25–30%, about 15–30% of which is sterols and also 15–30% of which is tocopherols. The remaining 70–75% of the material left after the distillates have been separated is the residue. The residue may be acidulated with a mineral acid to yield the fatty acids with low unsaponifiables, the upgraded fatty acids, which may be distilled, such as by known methods for the distillation of fatty acids or even the use of thin film or short-path evaporators, to yield higher quality fatty acids with an acid number on the order of 190–200. These fatty acids are those which were lost in the deodorizer distillates.

The distillate from above, which contains the sterols, tocopherols, and other unsaponifiables, optionally undergoes further purification, depending on the quality of the first slurry or distillate. Other separation and/or purification methods may also be used for optional purification, including other distillation techniques and chromatographic techniques. One option for further purification is to subject the distillate to a further distillation, such as by using a short-path evaporator. Conditions used for the short path evaporator are a temperature of about 110–160° C. and a pressure of about 0.001–0.01 mbar, but may vary depending upon the actual contents of the distillate. The distillate fraction (following re-distillation) generally yields about 15–30% and is rich in remaining acid components (e.g. fatty acids), lighter unsaponifiable components, and at least some part of the tocopherols. The residue portion following re-distillation generally has a yield of about 70–85%, about 25–35% of which is sterols.

Once a high quality slurry is obtained, whether it is the original distillate or the residue resulting from subjecting the original distillate to a further distillation (re-distillation), a crystallization, as discussed in more detail below in the section Crystallization of Sterols, may be performed to purify the sterols. In the case of DDOS as starting material, the mother liquor from the crystallization is usually rich in tocopherols.

Black Liquor Soap Skimmings (BLSS) as Starting Material

One starting material of note is black liquor soap skimmings (BLSS), which is the skim soap residue of the Kraft sulfate paper pulping process. The saponifiable components are mainly fatty and rosin acids and the unsaponifiable components include about 4% sterols, with the exact composition of the material depending upon several factors including the type of pine species or source of the trees, Kraft process conditions, and the tall oil recovery process used. Generally, the saponifiable components in BLSS are in the form of sodium soaps. Because BLSS is essentially a waste product or by-product, it is often desirable to pre-treat the material, such as by filtering and/or washing, in order to remove unwanted impurities derived from the paper mills.

The BLSS is washed with a caustic solution and water, preferably at a temperature of about 65–75° C. The BLSS is then filtered to separate any solid particles, such as pieces of wood, or any other impurities in the material from the paper mill's waste. The washed BLSS is then fed into a decanter to separate it from the dirty water from the washing process.

The washed BLSS is then totally or partially reacted with one or more metal sulfates, metal oxides, metal hydroxides, metal acetates or metal carbonates, or other metal bases, to form a lower melting point and lower viscosity metal soap mixture. The resulting metal soap mixture generally has a water content of about 40–50%. The metal soap is then washed with more water and part of the total water is separated out, preferably by the use of a centrifugation process. Because the viscosity of the soap mixture rises dramatically when the water is removed, the material has about 15–20% water following centrifugation. The metal soap mixture containing about 15–20% water is then fed into a thin-film evaporator in order to dry the metal soap mixture so that only residual levels of humidity remain. The thin-film evaporator is preferably run at a temperature of about 180–230° C. and a pressure of about 10–500 mbar. The exact conditions to use depend in part upon the actual metal soap used and may be determined by reviewing the properties of the metal salt or by routine experimentation. The dried metal soap mixture is then ready for the next step.

The dry metal soap mixture is fed into a thin-film evaporator to remove light to medium-light components and some or all of the residual humidity. Operating conditions utilized are preferably a temperature of about 150–230° C. and a pressure of about 0.1–40 mbar. The distillate yield is generally in the range of about 1–6% (lighter material).

The metal soap mixture, now substantially without lights, is fed into a molecular distillation column or short-path evaporator. In this step, the sterols and the rest of the unsaponifiables are distilled. Operating conditions utilized are preferably a temperature of about 240–300° C. and a pressure of about 0.001–0.1 mbar. The distillate yield is generally in the range of about 7–15% and comprises the sterol rich fraction. The residue, the remaining 85–93% of the material left after the distillates have been separated, may be acidulated with a mineral acid to yield the fatty/rosin acids with low unsaponifiables and the upgraded CTO, which is then subjected to a distillation to yield a high quality DTO with unsaponifiable content in the range of 0.5–1.5% and acid no. of 190, or it could be fractionated to separate the fatty from the rosin acids.

The distillate from above, which contains the sterols, may optionally undergo further purification. Further purification may be required depending on the quality of the first slurry or distillate. One option for further purification is to submit the distillate to an additional distillation (re-distillation), such as by using a short-path evaporator. Conditions used for the short path evaporator are a temperature of about 110–160° C. and a pressure of about 0.001–0.01 mbar, but may vary depending upon the actual contents of the distillate. The distillate fraction (following re-distillation) generally yields about 15–30% and is rich in remaining acid components and lighter unsaponifiable components like wax or fatty alcohols and/or some stilbenes as well. The residue portion following re-distillation generally has a yield of about 70–85% and is rich in sterols, with concentrations generally on the order of 35–50% sterols.

Other separation and/or purification methods may also be used for the optional purification, including other distillation techniques and chromatographic techniques. Furthermore, in cases where the slurry contains a higher acid content, which inhibits the crystallization process, it may be desired that the slurry be neutralized before proceeding. The acid number can be neutralized with a metal oxide and/or a metal hydroxide to form a metal soap with a very high content of sterols. Using the same principles for the distillation which begins with the metal soap mixture without lights described immediately above, the material may be submitted to distillation in a short-path evaporator in which operating conditions utilized are preferably a temperature of about 240–300° C. and a pressure of about 0.001–0.1 mbar. The distillate generally has a yield of about 80–90% (containing about 35–50% sterols) and is in a form to undergo a final crystallization, if desired.

Once a high quality slurry is obtained, whether it is the original distillate or the residue from the re-distillation, a crystallization, as discussed in more detail below in the section Crystallization of Sterols, may be performed to purify the sterols.

Crystallization of Sterols

Crystallization can be carried out with any suitable solvent, including, but not limited to alcohols such as ethanol and methanol, hydrocarbons such as heptane and hexane, water, and other organic solvents such as acetone. Mixtures of one or more such solvents may also be used. In some case, solvent mixtures are disfavored due to the higher costs associated with solvent recovery which may negatively effect the economics of the process as a whole. In some cases, where the economics of the product justifies the process, such as with pharmaceutical grade products, use of solvent mixtures is more feasible. The final temperatures for crystallization may be about 0–30° C. depending on purity and yield requirements and preferably the ratio of ethanol to crude sterols is about 4:1, 3:1, or 2:1, or, in the case of a mixed ethanol/water solvent, the ratio of ethanol to water to crude sterols is preferably 3:0.03:1. Final purity of the sterols can be, and are preferably, in the range of 85–98% pure.

Other raw materials having animal or vegetable origin which comprise unsaponifiable and saponifiable components are also good choices for starting materials for the application of the disclosed methods. The methods involving those materials proceed in a similar fashion to what has already been described, and may be developed using routine experimentation by a skilled artisan.

In a matrix where the acids are not free in the case of animal fats, we can hydrolyze the triglycerides (fat splitting) into fatty acids and again we would have a matrix where fatty acids and unsaponifiable material will be present. The same process can again be used to extract and concentrate the unsaponifiables, which are the main product of interest. In the end, there will be metal soaps without unsaponifiable materials, which in turn can be acidulated to generate high quality acids.

The tables which follow have the objective of clarifying the process and the examples given. Table 1 shows the melting points of the zinc, iron and magnesium soaps, and the blends of the same with dry sodium soap from cellulose production "black liquor soap skimmings" (BLSS).

TABLE 1

| | % Na Soap (from BLSS) | Melting Point (° C.) |
|---|---|---|
| % Zn Soap (from BLSS) | | |
| 0 | 100 | 230 |
| 28 | 72 | 170 |
| 44 | 56 | 128 |
| 61 | 39 | 96 |
| 100 | 0 | 81 |
| % Fe Soap (from BLSS) | | |
| 0 | 100 | 230 |
| 28 | 72 | 171 |
| 44 | 56 | 140 |
| 61 | 39 | 120 |
| 100 | 0 | 60 |
| % Mg Soap (from BLSS) | | |
| 0 | 100 | 230 |
| 28 | 72 | 170 |
| 44 | 56 | 140 |
| 61 | 39 | 115 |
| 100 | 0 | 95 |

As shown in the results presented in Table 1, the transformation of BLSS sodium soap into Zn, Mg, or Fe soaps, decreases the melting point, significantly. The mixture of sodium or potassium soaps with Zn, Mg, Fe soaps, either formed by partial transformation of sodium soaps, or by their blending, also decreases the melting point.

Table 2 shows the characteristics of the tall oil obtained from hydrolyzed BLSS magnesium soap residue after short path evaporation (see Example 1), as compared to the tall oil obtained from direct acidulation of BLSS.

TABLE 2

| | Tall Oil | |
|---|---|---|
| | Direct acidulation | From Mg Soap residue |
| Acid value, MgKOH/g | 145.0 | 178.0 |
| Saponiflcation value, MgKOH/g | 155.0 | 182.0 |
| Unsaponifiables (%) | 16.0 | 3.3 |
| Neutrals (%) | 17.0 | 3.9 |
| Rosin acids (%) | 39.0 | 36.8 |
| Fatty acid composition (by gas chromatography) | % | % |
| Palmitic acid | 5.2 | 4.8 |
| Stearic acid | 2.0 | 1.3 |
| Oleic acid | 28.0 | 26.4 |
| Linoleic acid | 22.0 | 19.2 |
| Abietic acid | 17.3 | 15.2 |
| Dehydroabietic acid | 5.0 | 8.4 |

Table 3 shows the specifications of the upgraded CTO after it was submitted to a distillation, in order to de-pitch the Tall Oil, giving the upgraded DTO, distilled Tall Oil.

TABLE 3

| Distilled "Upgraded Tall Oil" De-pitched "Upgraded Tall Oil" | |
|---|---|
| Acid value, MgKOH/g | 195.0 |
| Saponifcation value, MgKOH/g | 204.17 |
| Unsaponifiables (%) | 1.02 |
| Neutrals (%) | 1.31 |
| Rosin acids (%) | 45.87 |
| **Fatty acid composition (by gas chromatography)** | **%** |
| Palmitic acid | 5.62 |
| Stearic acid | 1.39 |
| Oleic acid | 26.24 |
| Linoleic acid | 17.12 |
| Abietic acid | 11.72 |
| Dehydroabietic acid | 6.11 |

Next, some examples of the separation of unsaponifiable substances, containing liposoluble vitamins and provitamins, growth factors, and vegetable hormones from residues of industrialized animal and vegetable products. In other words, the separation process of the "valuable products", without the use of solvents obtained through the present process, will be described.

EXAMPLE 1

5 Kg of black liquor sodium soap skimming (BLSS) with 50% water content, obtained from the process of cellulose production, was diluted with 50% water and transformed into magnesium soap with magnesium sulfate, calculated with approximately a 30% excess margin. The transformation was carried out in a stirrer and heater reactor. Reaction temperature was maintained at 80–95° C. When most of the sodium soap is transformed into magnesium soap, the phase separation occurs. After that, the water phase containing an excess of sodium and magnesium sulfate from BLSS, was separated from the magnesium soap, by decantation. Magnesium soap was dried under reduced pressure, at a temperature of 90–150° C., for 40 minutes. The dry soap was then filtered in order to remove solid material, after which, it was submitted to evaporation/distillation in short path evaporation pilot equipment. The pilot evaporator used, was made of glass and had 4.8 $dm^2$ of evaporation/distillation surface with a variable temperature of 25–350° C., and an internal superficial scraper stirrer with a variable rotation of 50–1000 rpm, and a 6.5 $dm^2$ surface internal condenser with an adjustable temperature of 25–250° C. The equipment also had a feeding system with a 0.1–5 liter/h adjustable pump and a feeding vessel with an adjustable temperature of 25–250° C. It was also equipped with a two stage high vacuum system, in which the pre-vacuum is formed by a mechanical pump and the final vacuum is obtained by a molecular diffusion pump, where the absolute pressure can be adjusted from atmospheric pressure up to 1×10−3 mbar. The concentration of sterols in the soap mixture was carried out through various short path evaporation stages. The first evaporation was carried out at around 280–300° C., feeding flow was maintained at 1 to 1.5 l/h, evaporation pressure was 1×10−3 mbar absolute, the temperature of the internal condenser was maintained at 70–80° C., and feeding temperature at 150–170° C. Under these conditions, yields of 84% and 16%, for residue and distillate respectively, were obtained. Practically all of the sterols in the soap have been distilled and concentrated in the distillate, the concentration of which were 0.9 and 20.3% for the residue and the distillate, respectively. The first distillate obtained was then subjected to another distillation (i.e. it was re-distilled) at a temperature of 280° C., maintaining the same parameters as those in the beginning. This second distillation was 1.6% and 14.4% for the residue and the distillate respectively, in comparison to the initial material. In this second distillation, the sterols were concentrated in the distillate. The residue and the distillate showed a concentration of 1.6% and 22.4% respectively for sterols. The distillate from the second distillation was put through a third distillation, at a temperature of 160° C. The objective of the third distillation was to remove the acidity and low boiling point components. With regard to the initial material used, the last yields for residue and distilled product, during the final distillation process, were 8.4% and 6.0%. respectively. Total sterol concentrations in these fractions were 35.4% in the residue and 4.23% in the distilled product. The increase of sterols in the residue of the third distillation was 8.9 times greater than in the beginning, where total sterols were 4%. The total sterol recovery yield, in this experiment, was 80%. An extremely good quality "tall oil" was obtained after the acid hydrolysis of the residue from the first distillation. This improvement in the quality of the "tall oil" obtained, compared to that produced by direct hydrolysis of BLSS sodium soap, due to the removal of most of the neutral substances and unsaponifiables before hydrolysis, in other words, in the distillation. An analysis of the tall oil obtained from the hydrolysis of the residue taken from the first distillation, is shown in Table 2.

EXAMPLE 2

5 Kg of soybean oil deodorizer distillate (DDOS) was saponified under 2 $Kg/cm^2$ pressure at a temperature of 120° C., using 1.4 Kg of 50% sodium hydroxide solution for 2 hours. Next, sodium soap was diluted in 5 Kg of water, after which, it was transformed into magnesium soap by reacting with 30% calculated excess magnesium sulfate solution. The transformation was carried out in a stirrer reactor at a temperature of 90–95° C. After the reaction, the water phase was removed from the magnesium soap by means of decantation. Next the soap mixture was dried under reduced pressure at a temperature of 90–140° C. After that the dry soap was filtered and submitted to various stages of short path evaporation. The first distillation/evaporation was carried out using the same parameters mentioned in Example 1. The yields from the residue and the distilled product (i.e. distillate), taken from the first distillation/evaporation, were 63% and 37%, respectively. Tocopherols and sterols concentrate in the distilled product and their values were 8.0% and 10.4%. In the residue, tocopherols and sterols were found in concentrations of 0.4% and 1.37%, respectively. The first distilled product was submitted to a second distillation/evaporation at 280° C., in order to separate the remaining soap in the first distilled product. In this second distillation, the residue and distilled product yields were 2.6% and 34.4%, when compared to the initial material. Total tocopherol and sterol concentrations, in the distilled product, were 8.5% and 11.4%, respectively. The concentrations of tocopherols and sterols, in the residue, were 0.38% and 0.24% respectively. The second distilled product was once again subjected to distillation at 140° C., maintaining all other parameters according to the conditions presented in Example 1. In this distillation, the residue and distilled product yields were 21.6% and 12.8% respectively compared to the initial material. Tocopherol and sterol concentrations in the residue were 13.0% and 17.9%, respectively. On the other hand, tocopherol and sterol concentrations, in the distilled product, were 0.93% and 0.50% respectively. This represents an increase of 4 times the amount of tocopherol and 3.7 times that of sterol, with a recovery of 87.8% and 80.5%, in relation to the starting material.

EXAMPLE 3

5 Kg of tall oil pitch underwent hydrolysis with high-pressure steam for 2 hours. The hydrolyzed pitch suffered evaporation/distillation at 280° C. Residue and distilled product yields were 35% and 65%, respectively. The hydrolyzed pitch distilled product was neutralized, without excess, with a magnesium oxide suspension in water, at 95° C. for 3 hours. The magnesium soap was dried under reduced pressure and submitted to short path evaporation at a temperature of 280° C. Residue and distilled product yields were 37% and 63% respectively. Sterols were concentrated in the distilled product. The proportion of sterols in the residue and distilled product were 0.8% and 39.5% respectively. This represents an increase of 3.9 times more than in the concentration of the initial material. The sterol recovery obtained in this experiment was 79%.

EXAMPLE 4

8 Kg of CTO (crude tall oil) was pre-mixed with 1.04 Kg of ZnO in an industrial mixing blender, in order to provide a homogenized mixture between the CTO and the solid ZnO, which was dispersed into the CTO. This mixture forms a whitish, yellowish paste, this characteristic indicates that the ZnO has not reacted with the CTO yet, but it is well mixed within the CTO, at the end of the reactions the material is brownish, caramel color.

The mixture from above was then placed inside a reactor and reacted at a temperature of about 100° C. such that the dispersed ZnO neutralized the rosin and fatty acids of the pitch partially or totally. In addition, 320 grams of NaOH dissolved in 320 grams of water was added to the reactor contents, and the mixture allowed to continue reacting to a final temperature of 160° C. under vacuum. The reaction was performed with the reactor under vacuum (reduced pressure) which allowed for removal of the water generated by the neutralization reaction (approx. 6%). Following the reaction, the mixture had a brownish, caramel color. Total reaction time nixing included was about 90 minutes, and produced a feed material product comprising a blend of zinc and sodium soaps (Zn-Na soap).

This product was then fed into a wiped film evaporator in order to distill light unsaponifiable materials and all residual humidity down to about 0.01%, this humidity level is preferred for vacuum operation in the range of 0.01–0.001 mbar. The conditions used were as follows: distillation temperature 180° C.; distillation pressure 0.1 mbar; feed temperature 120° C.; and condenser temperature 60° C. The distillate yield was about 5.5% (light fraction containing stilbenes, some humidity). The residue yield was about 94.5% (sterol-containing fraction comprising about 4.30% sterols).

The residue was then fed into a molecular distillation column in order to distill the unsaponifiable materials, including the sterols. The conditions used were as follows: distillation temperature 270° C.; distillation pressure $2.0\times10^{-2}$ mbar; feed temperature 140° C.; and internal condenser temperature 70° C. The distillate yield was 9.0%, and the distillate sterol concentration was determine to be 35.0%. This yields a sterol recovery of 73.26% from the initial feed material. The residue yield was 91%. The residue was acidulated with sulfuric acid in order to form the higher quality CTO with lower unsaponifiable content. The upgraded CTO was then distilled in a wiped film evaporator at a temperature of about 240° C. and at a pressure of 3 mbar, resulting in a distillate yield of 83%. The distilled tall oil had an acid number of 190 and contained 0.6% unsaponifiables.

The distillate obtained from the sterol extraction distillation ("the slurry") had a sterol content of about 35% and was submitted to distillation once more in a short-path evaporator at a temperature of 150° C. and a pressure of 0.03 mbar. The distillate yield was 22.8% and consisted mainly of medium-light unsaponifiable components and some acidic components derived from slight decomposition of the metal soap in the previous distillation. The residue yield was 77.2%, with a sterol concentration of 43%. This slurry was submitted to crystallization with ethanol to yield a product with 98% purity. The crystallization yield for this particular crystallization was only 50%; however, the mother liquor after the ethanol was recovered gave a product with 18% sterol concentration, which can be mixed back into a preferred stage of the process.

EXAMPLE 5

This example demonstrates one preferred method of extracting and concentrating tocopherol and sterols from Soya deodorizer distillates by-products (DDOS). DDOS generally comprises about 35% Fatty Acids, about 30% neutral oil and polymers, and about 35% unsaponifiable material, including sterols and tocopherols.

The DDOS was submitted to distillation using a molecular distillation apparatus at a temperature of about 300° C. and a pressure of about $2.0\times10^{-2}$ mbar. The distillate yield was 66.5%, with a sterol content of 6.14% and a tocopherols content of 8.5%. The distillate was then collected and its acid number determined, such as by known methods, which was then used to calculate the amount of ZnO needed to neutralize the fatty acids to make Zn soap. The calculated amount of ZnO was then added and the resulting Zn soap was subjected to distillation/evaporation in a wiped film evaporator to remove lights under similar conditions as for the sterol process in Example 4, whereby the lights are removed.

The residue was then submitted to distillation in a short path still, in order to separate the unsaponifiables, under conditions similar to those detailed in Example 4. The distillate contained about 20% tocopherols and about 15% sterols and some fatty acids.

Lastly, the residue from the distillation was acidulated to recover high quality fatty acids. The recovered fatty acids were then distilled in a wiped film evaporator at a temperature of 240° C. and at a pressure of 3 mbar, the resulting distilled fatty acids yield an acid no. of 200.

EXAMPLE 6

20 Kg of tall oil pitch was submitted to a high pressure hydrolysis using water as a solvent in order to hydrolyze the sterol esters into free sterols and fatty/rosin acids. The reaction was carried out in a high-pressure autoclave operated under about 20 bars of pressure and at a temperature of about 212° C. The resulting pitch, now containing about 15% free-sterols, was pre-mixed with 1.5 Kg (about 7.5%) of ZnO in an industrial mixing blender, in order to provide a homogenized mixture between the treated pitch and the solid ZnO, which was dispersed into the pitch to form a whitish, yellowish paste indicating that the ZnO had not yet reacted with the treated pitch.

The mixture from above was then placed inside a reactor and reacted at a temperature of 100° C. such that the dispersed ZnO neutralized the rosin and fatty acids of the pitch partially or totally. In addition, 1120 grams of KOH dissolved in 1120 grams of water was added to the reactor contents and the mixture continue to react to a final temperature of 160° C. under vacuum. The reaction was performed with the reactor under vacuum (reduced pressure) which allowed for removal of the water generated by the neutralization reaction, approx. 6%. Following the reaction, the mixture had a brownish, caramel color. Total reaction time, mixing included, was about 90 minutes, and produced a feed material product comprising a blend of zinc and potassium soaps (Zn-K soap).

The Zn-K soap was then fed into a wiped film evaporator in order to distill lights. The conditions used were as follows: distillation temperature 200° C.; distillation pressure 3 mbar; feed temperature 120° C.; and condenser temperature 60° C. The distillate yield was 2% (light fraction, some humidity) and the residue yield was 98% (sterol containing fraction about 18% sterol concentration)

The residue was then fed into a molecular distillation column in order to distill the unsaponifiable materials, including the sterols. The conditions used were as follows: distillation temperature 270° C.; distillation pressure $2.0\times10^{-2}$ mbar; feed temperature 140° C.; and internal condenser temperature 80° C. The distillate yield was 30%, and the distillate sterol concentration was determine to be 51.43%. This yields a sterol recovery in the range of about 85% to 96% from the initial feed material. It is often difficult to ascertain the exact yield because it is very difficult to analyze sterol content in the initial pitch samples using the gas chromatograph, but, on average the pitch contains from 15–18% sterols. The residue yield was 70%. The residue was acidulated with sulfuric acid in order to recover the remaining rosin/fatty acids with lower unsaponifiable content. The rosin and fatty acids recovered from the pitch were then submitted to further distillation in a wiped film evaporator with a temperature of 240° C. and a pressure of 3 mbar. The final distilled mixture of fatty and rosin acids had an acid number of 183 and rosin content of 40%. Part of the earlier distillate was submitted to a single crystallization with ethanol to a final temp of 20° C. to purify the sterols to concentrations above 96% (crystallization yield was 70%). The other part was submitted to a crystallization using ethanol and water to a final temp.15° C. to purify the sterols to 97.67% (crystallization yield was 80%).

EXAMPLE 7

20 Kg of tall oil pitch wag submitted to a high pressure hydrolysis using water as a solvent in order to hydrolyze the sterol esters into free sterols and fatty/rosin acids. The reaction was carried out in a high-pressure autoclave operated under 20 bar of pressure and at a temperature of 200° C. Following hydrolysis, the pitch comprises free sterols, fatty/rosin acids, and some dimerized heavier material.

The hydrolyzed pitch was then fed into a short-path evaporator to distill the acids and unsaponifiables, including the free sterols, and to leave the heavier materials in the residue, referred to herein as de-pitching the pitch. The conditions used were as follows: distillation temperature 300° C.; distillation pressure $2.0\times10^{-2}$ mbar; feed temperature 80° C.; and internal condenser temperature 70° C. The distillate yield was 75%, and comprised a blend of rosin acids, fatty acids, and unsaponifiables including sterols. The residue yield was 25% and included residual dimerized heavy materials.

The resulting distillate from the above distillation was pre-mixed with 1.5 Kg of ZnO (about 7.5%)in an industrial mixing blender, in order to provide a homogenized mixture between the pitch and the solid ZnO, which was dispersed into the treated distilled pitch. This mixture was a whitish, yellowish paste.

The mixture from above was then placed inside a reactor and reacted at a temperature of 100° C. such that the dispersed ZnO neutralized the rosin and fatty acids of the pitch partially or totally. In addition, 800 grams of NaOH dissolved in 800 grams of water was added to the reactor contents, and the mixture allowed to continue reacting to a final temperature of 160° C. under vacuum. The reaction was performed with the reactor under vacuum (reduced pressure) which allowed for removal of the water generated by the neutralization reaction (approx. 6%). Following the reaction, the mixture had a brownish, caramel color. Total reaction time, mixing included, was about 90 minutes, and produced a feed material product comprising a blend of zinc and sodium soaps (Zn—Na soap).

The Zn—Na soap was then fed into a wiped film evaporator in order to distill lights and remove residual humidity. The conditions used were as follows: distillation temperature 215° C.; distillation pressure 20 mbar; feed temperature 150° C.; and condenser temperature 80° C. The distillate yield was 1.2% (light fraction, some humidity) and the residue yield was 98.8% (sterol containing fraction about 19% sterol concentration)

The residue was then fed into a molecular distillation column in order to distill the unsaponifiable materials, including the sterols. The conditions used were as follows: distillation temperature 270° C.; distillation pressure $2.0\times10^{-2}$ mbar; feed temperature 150° C.; and condenser temperature 85° C. The distillate yield was 28.6%, and the distillate sterol concentration was determine to be 51.36%. This yields a sterol recovery of 76.30% from the initial feed material. The residue yield was 71.4%. The distillate was crystallized with ethanol to a final temp of 10° C. to purify the sterols to concentrations above 95%.

The residue was acidulated with sulfuric acid in order to recover the remaining rosin/fatty acids with lower unsaponifiable content. The acidulated residue was then submitted to distillation in order to further improve the quality of the rosin/fatty acids. The conditions used were as follows: distillation temperature 240° C.; distillation pressure 3.0 mbar; feed temperature 85° C.; and condenser temperature 65° C. The distillate from this step resulted in a blend of rosin/fatty acids having a Gardner scale color of 8, an acid value of 188.54 and comprising 37.49% rosin acids and 1.88% neutrals.

EXAMPLE 8

20 Kg of tall oil pitch, saponified with NaOH in order to hydrolyze the sterol esters into free sterols and fatty/rosin soap, then the saponifiade pitch was acidulated with sulfuric acid to yield a modified pitch with unsaponifiable components including free sterols, fatty and rosin acids. This modified pitch was fed into a short-path evaporator to distill the acids and unsaponifiables, including the free sterols, and to leave the heavier materials in the residue (de-pitching the pitch). The conditions used were as follows: distillation temperature 290° C.; distillation pressure $2.0\times10^{-2}$ mbar; feed temperature 80° C.; and internal condenser temperature 70° C. The distillate yield was 75.4%, and comprised a blend of rosin acids, fatty acids, and unsaponifiables including sterols. The residue yield was 24.6% and included residual dimerized heavy materials.

The resulting distillate from the above distillation was pre-mixed with 1.5 Kg of ZnO (about 7.5%)in an industrial mixing blender, in order to provide a homogenized mixture between the pitch and the solid ZnO, which was dispersed into the pitch. This mixture was a whitish, yellowish paste.

The mixture from above was then placed inside a reactor and reacted at a temperature of 100° C. such that the dispersed ZnO neutralized the rosin and fatty acids of the pitch partially or totally. In addition, 800 grams of NaOH dissolved in 800 grams of water was added to the reactor contents and the mixture allowed to continue reacting to a final temperature of 160° C. under vacuum. The reaction was performed with the reactor under vacuum (reduced pressure) which allowed for removal of the water generated by the neutralization reaction (approx. 6%). Following the reaction, the mixture had a brownish, caramel color. Total reaction time mixing included was about 90 minutes, and produced a feed material product comprising a blend of zinc and sodium soaps (Zn—Na soap).

The Zn—Na soap was then fed into a wiped film evaporator in order to distill lights and remove humidity. The conditions used were as follows: distillation temperature 215° C.; distillation pressure 20 mbar, feed temperature 150° C.; and condenser temperature 80° C. The distillate yield was 1.2% (light fraction, some humidity) and the residue yield was 98.8% (sterol-containing fraction about 16%). The residue was then fed into a molecular distillation column in order to distill the unsaponifiable materials, including the sterols. The conditions used were as follows: distillation temperature 270° C.; distillation pressure $2.0\times10^{-2}$ mbar; feed temperature 150° C.; and internal condenser temperature 85° C. The distillate yield was 28%, and the distillate sterol concentration was determined to be 50%. This yields a sterol recovery of 87.5% from the initial feed material. The residue yield was 72%. The distillate was crystallized with ethanol to a final temp of 10° C. to purify the sterols to concentrations above 95%.

The residue was acidulated with sulfuric acid in order to recover the remaining rosin/fatty acids with lower unsaponifiable content. The acidulated residue was then distilled in order to further improve the quality of the rosin/fatty acids. The conditions used were as follows: distillation temperature 240° C.; distillation pressure 3.0 mbar; feed temperature 85° C.; and condenser temperature 65° C. The distillate from this step resulted in a blend of rosin/fatty acids having a Gardner scale color of 8, an acid number of 188 and comprising 37.49% rosin acids and 1% unsaponifiables.

The various methods, techniques and aspects described above thus provide a number of ways to separate unsaponifiable (and/or saponifiable) valuable products from raw materials as described herein in reference to preferred embodiments.

Of course, it is to be understood that not necessarily all objectives or advantages described in reference to a particular embodiment herein may be achieved in accordance with any or all other embodiments of the invention. Thus, for example, those skilled in the art will recognize that the methods described may be performed in a manner that achieves or optimizes one advantage or group of advantages as taught herein without necessarily achieving other objectives or advantages as may be taught or suggested herein.

Furthermore, the skilled artisan will recognize the interchangeability of various features, method steps, or acts from different embodiments. Similarly, the various method steps and acts within such method steps discussed above, as well as other known equivalents for each such acts and/or steps, can be mixed and matched by one of ordinary skill in this art to develop methods in accordance with principles described herein.

Although the invention has been disclosed in the context of certain embodiments and examples, it will be understood by those skilled in the art that the invention extends beyond the specifically disclosed embodiments to other alternative embodiments and/or uses and obvious modifications and equivalents thereof.

What is claimed is:

1. A process for separating a valuable product from a raw material comprising:

providing a raw material comprising one or more unsaponifiable compounds and one or more saponifiable compounds, wherein the one or more saponifiable compounds comprises one or more compounds in free acid and/or soap form;

reacting the raw material with a sodium or potassium base to saponify free acid saponifiable compounds thereby forming a mixture comprising saponified compounds and unsaponifiable compounds reacting the saponifiable component comprising one or more compounds in free acid and/or soap form with a metal soap-forming compound to make a first product comprising metal soaps and one or more unsaponifiable compounds; and subjecting the mixture of metal soaps and one or more unsaponifiable compounds to a distillation to form a distillate comprising at least a portion of the unsaponifiable compounds and a residue comprising the metal soaps, wherein the distillate and/or the residue comprises a valuable product.

2. A process according to claim 1, wherein the raw material is selected from the group consisting of black liquor skimming soap, tall oil soap, crude tall oil, tall oil pitch, sugarcane oil, residues from extraction, degumming, and refining of oils and fats, distillation residues of fatty acids and esters of animal and/or vegetable origin, deodorization distillates of vegetable oils, soybean oil, rice bran oil, shark liver oil, beef tallow, coffee oil, fish oil, cod liver oil, wheat germ oil, corn germ oil, palm oils, andiroba oils, and oil from tomato residues.

3. A process according to claim 1, wherein the metal soap-forming compound is selected from the group consisting of oxides, sulfates, hydroxides, carbonates, acetates and chlorides of zinc, iron, manganese, magnesium, calcium, copper, cobalt, lead and aluminum.

4. A process according to claim 1, wherein the valuable product is selected from the group consisting of provitamins, growth factors, flavonoids, sterols, lipoproteins, stilbenes, vitamins, fatty and wax alcohols, diterpenes, steroids, triterpenes, stilbenes, fatty acids, and rosin acids.

5. A process according to claim 1, wherein the valuable product is selected from the group consisting of tocopherols, tocotrienols, carotenoids, vitamin A, vitamin K, vitamin D, squalane, oryzanol, lycopene, ceryl alcohol, cetyl alcohol, lignoceryl alcohol, behenyl alcohol, resin alcohols, resin aldehydes, labdanes, sitosterol, stigmastanol, campesterol, campestanol, cholesterol, cycloartenol, 3,5-stigmastadien-7-one, serratenediol, squalene; prenols, trans-pinosylvin dimethyl ether, abietic acid, dehydroabietic acid, neoabietic acid, isopimaric acid, pimaric acid, paulstric acid, oleic acid, linoleic acid, stearic acid, and palmitic acid.

6. A process according to claim 1, wherein the sodium or potassium base is selected from the group consisting of sodium hydroxide and potassium hydroxide.

7. A process according to claim 1, wherein the raw material further comprises esters that are hydrolyzed upon exposure to the sodium or potassium base.

8. A process according to claim 1, further comprising adding a mineral acid to at least a portion of the saponified compounds to form an acidulated mixture prior to the reacting with the sodium or potassium base.

9. A process according to claim 8, further comprising subjecting the acidulated mixture to a distillation to produce a residue comprising one or more non-volatile compounds and a distillate comprising one or more unsaponifiable compounds and one or more saponifiable compounds prior to the reacting with the sodium or potassium base.

10. A process according to claim 1, further comprising subjecting the raw material to a distillation to produce a residue comprising one or more non-volatile compounds and a distillate comprising one or more unsaponifiable compounds and one or more saponifiable compounds prior to the reacting with the sodium or potassium base.

11. A process according to claim 1, wherein the raw material further comprises esters that are hydrolyzed to make a raw material including hydrolyzed esters prior to the reacting with the sodium or potassium base.

12. A process according to claim 11, wherein the hydrolysis is performed by combining the raw material with water under high pressure and high temperature.

13. A process according to claim 11, further comprising subjecting the raw material including hydrolyzed esters to a distillation to produce a residue comprising one or more non-volatile compounds and a distillate comprising one or more unsaponifiable compounds and one or more saponifiable compounds prior to the reacting with the sodium or potassium base.

14. A process according to claim 1, further comprising treating the raw material to remove impurities and/or non-volatile compounds prior to the reacting with the sodium or potassium base.

15. A process according to claim 1, wherein the first product is substantially dry.

16. A process according to claim 1, further comprising treating the first product to remove water prior to the distilling to separate at least a portion of the unsaponifiable compounds from the metal soaps.

17. A process according to claim 16, wherein the removal of water is effected by thin-film evaporation, decantation and/or centrifugation.

18. A process according to claim 1, further comprising distilling or evaporating one or more compounds selected from the group consisting of lights, medium-lights, and water from the first product prior to the distilling to separate at least a portion of the unsaponifiable compounds from the metal soaps.

19. A process according to claim 1, further comprising subjecting the distillate comprising at least a portion of the unsaponifiable compounds to a subsequent distillation to form a second distillate and a second residue, thereby further purifying and/or separating the unsaponifiable compounds.

20. A process according to claim 19, wherein the second residue comprises sterols, further comprising crystallizing the sterols in the second residue.

21. A process according to claim 1, further comprising acidulating the residue comprising the metal soaps to form their corresponding free acids.

22. A process according to claim 21, further comprising distilling the free acids.

23. A process for separating the components of crude tall oil, comprising:

providing crude tall oil comprising one or more unsaponifiable compounds and two or more saponifiable compounds, wherein the saponifiable compounds comprise fatty acids and rosin acids in free acid and/or soap form;

reacting the saponifiable compounds with a metal soap-forming compound to make a first product comprising metal soaps and one or more unsaponifiable compounds;

distilling or evaporating one or more compounds selected from the group consisting of lights, medium-lights, water, and unsaponifiable compounds from the first product;

distilling a mixture of metal soaps and one or more unsaponifiable compounds to form a distillate comprising at least a portion of the unsaponifiable compounds and a residue comprising the metal soaps; and acidifying the residue to form a mixture comprising the rosin acids and fatty acids substantially in free acid form.

24. A process for separating a valuable product from a raw material comprising:

providing a raw material comprising one or more unsaponifiable compounds and one or more saponifiable compounds, wherein the one or more saponifiable compounds comprises one or more compounds in free acid and/or soap form;

reacting the saponifiable component comprising one or more compounds in free acid and/or soap form with a sodium and/or potassium base thereby forming sodium and/or potassium soaps;

reacting the sodium and/or potassium soaps with a metal soap forming compound to make a first product comprising metal soaps and one or more unsaponifiable compounds; and subjecting a mixture of metal soaps and one or more unsaponifiable compounds to a distillation to form distillate comprising at least a portion of the unsaponifiable compounds and a residue comprising the metal soaps, wherein the distillate and/or the residue comprises the valuable product.

25. A process according to claim 24, wherein the metal soap-forming compound is selected from the group consisting of oxides, sulfates, hydroxides, carbonates, acetates and chlorides of zinc, iron, manganese, magnesium, calcium, copper, cobalt, lead and aluminum.

26. A process according to claim 24, wherein the raw material is selected from the group consisting of black liquor skimming soap, tall oil soap, crude tall oil, tall oil pitch, sugarcane oil, residues from extraction, degumming, and refining of oils and fats, distillation residues of fatty acids and esters of animal and/or vegetable origin, deodorization distillates of vegetable oils, soybean oil, rice bran oil, shark liver oil, beef tallow, coffee oil, fish oil, cod liver oil, wheat germ oil, corn germ oil, palm oils, andiroba oils, and oil from tomato residues.

27. A process according to claim 24, wherein the valuable product is selected from the group consisting of provitamins, growth factors, flavonoids, sterols, lipoproteins, stilbenes, vitamins, fatty and wax alcohols, diterpenes, steroids, triterpenes, stilbenes, fatty acids, and rosin acids.

28. A process according to claim 24, wherein the valuable product is selected from the group consisting of tocopherols, tocotrienols, carotenoids, vitamin A, vitamin K, vitamin D, squalane, oryzanol, lycopene, ceryl alcohol, cetyl alcohol, lignoceryl alcohol, behenyl alcohol, resin alcohols, resin aldehydes, labdanes, sitosterol, stigmastanol, campesterol, campestanol, cholesterol, cycloartenol, 3,5-stigmastadien-7-one, serratenediol, squalene; prenols, trans-pinosylvin dimethyl ether, abietic acid, dehydroabietic acid, neoabietic acid, isopimaric acid, pimaric acid, paulstric acid, oleic acid, linoleic acid, stearic acid, and palmitic acid.

29. A process for separating a valuable product from a raw material comprising:

providing a raw material comprising one or more unsaponifiable compounds and one or more saponifiable compounds, wherein the one or more saponifiable compounds comprises one or more compounds in free acid and/or soap form;

reacting the saponifiable component comprising one or more compounds in free acid and/or soap form with a metal soap-forming compound to make a first product comprising metal soaps and one or more unsaponifiable compounds;

treating the first product to remove water, wherein the removal of water is effected by thin-film evaporation, decantation and/or centrifugation.

subjecting the first product to a distillation to form a distillate comprising at least a portion of the unsaponifiable compounds and a residue comprising the metal soaps, wherein the distillate and/or the residue comprises a valuable product.

30. A process according to claim 29, wherein the metal soap-forming compound is selected from the group consisting of oxides, sulfates, hydroxides, carbonates, acetates and chlorides of zinc, iron, manganese, magnesium, calcium, copper, cobalt, lead and aluminum.

31. A process according to claim 29, wherein the raw material is selected from the group consisting of black liquor skimming soap, tall oil soap, crude tall oil, tall oil pitch, sugarcane oil, residues from extraction, degumming, and refining of oils and fats, distillation residues of fatty acids and esters of animal and/or vegetable origin, deodorization distillates of vegetable oils, soybean oil, rice bran oil, shark liver oil, beef tallow, coffee oil, fish oil, cod liver oil, wheat germ oil, corn germ oil, palm oils, andiroba oils, and oil from tomato residues.

32. A process according to claim 24, wherein the valuable product is selected from the group consisting of provitamins, growth factors, flavonoids, sterols, lipoproteins, stilbenes, vitamins, fatty and wax alcohols, diterpenes, steroids, triterpenes, stilbenes, fatty acids, and rosin acids.

33. A process according to claim 24, wherein the valuable product is selected from the group consisting of tocopherols, tocotrienols, carotenoids, vitamin A, vitamin K, vitamin D, squalane, oryzanol, lycopene, ceryl alcohol, cetyl alcohol, lignoceryl alcohol, behenyl alcohol, resin alcohols, resin aldehydes, labdanes, sitosterol, stigmastanol, campesterol, campestanol, cholesterol, cycloartenol 3,5-stigmastadien-7-one, serratenediol, squalene; prenols, trans-pinosylvin dimethyl ether, abietic acid, dehydroabietic acid, neoabietic acid, isopimaric acid, pimaric acid, paulstric acid, oleic acid, linoleic acid, stearic acid, and palmitic acid.

34. A process according to claim 29, wherein the raw material further comprises esters that are hydrolyzed to make a raw material including hydrolyzed esters prior to the reacting to make the first product.

35. A process according to claim 34, further comprising subjecting the raw material including hydrolyzed esters to a distillation to produce a residue comprising one or more non-volatile compounds and a distillate comprising one or more unsaponifiable compounds and one or more saponifiable compounds prior to the reacting to make the first product.

36. A process according to claim 29, further comprising subjecting the distillate comprising at least a portion of the unsaponifiable compounds to a subsequent distillation to form a second distillate and a second residue, thereby further purifying and/or separating the unsaponifiable compounds.

37. A process according to claim 29, further comprising acidulating the residue comprising the metal soaps to form their corresponding free acids.

* * * * *

UNITED STATES PATENT AND TRADEMARK OFFICE

CERTIFICATE OF CORRECTION

PATENT NO. : 6,846,941 B2
DATED : January 25, 2005
INVENTOR(S) : Rohr et al.

It is certified that error appears in the above-identified patent and that said Letters Patent is hereby corrected as shown below:

Title page,
Item [56], References Cited, FOREIGN PATENT DOCUMENTS,
delete "WO 01/83855" and insert -- WO 01/83655. --.
Item [57], ABSTRACT,
Line 9, delete "distillation evaporation", and insert -- distillation/evaporation --.

Column 33,
Line 11, after "centrifugation", replace "." with -- ; --.

Column 34,
Line 9, after "cycloartenol", insert -- , --.

Signed and Sealed this

Twenty-eighth Day of March, 2006

JON W. DUDAS
*Director of the United States Patent and Trademark Office*